US006797904B1

(12) United States Patent
Ni

(10) Patent No.: US 6,797,904 B1
(45) Date of Patent: Sep. 28, 2004

(54) MICROSWITCH

(75) Inventor: Yu-Ting Ni, Taipei Hsien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/751,407

(22) Filed: Jan. 6, 2004

(51) Int. Cl.[7] ..... H01H 3/04
(52) U.S. Cl. ..... 200/335; 200/6 BB
(58) Field of Search ..... 200/313–315, 200/335, 339, 553–562, 535, 6 B, 6 BA, 6 C

(56) References Cited

U.S. PATENT DOCUMENTS 3,878,344 A * 4/1975 Lockard ..... 200/6 B
3,965,319 A * 6/1976 Lockard ..... 200/310
4,081,632 A * 3/1978 Schaffeler ..... 200/6 BB
2002/0148714 A1 10/2002 Minami et al.

FOREIGN PATENT DOCUMENTS

TW 517254 A 1/2003
TW 562228 A 11/2003

* cited by examiner

*Primary Examiner*—Elvin Enad
*Assistant Examiner*—Lisa Klaus
(74) *Attorney, Agent, or Firm*—Birch, Stewart, Kolasch & Birch, LLP

(57) ABSTRACT

This invention discloses a microswitch that is easy to assemble and manufacture. The microswitch of this invention constantly keeps the first conductive section of a resilient component for opening/closing an electrical switch in contact with the first conductive terminal in the main body of the microswitch, and houses a plate-shaped second conductive section with a contact surface inside the main body of the microswitch, so that the second conductive section of the resilient component is driven by a press button on the contact surface of the second conductive terminal to preset the signal from an initial connection state to a final connection state in order to increase the distance required for controlling the signal connection and allow the resilient component to have an effective deformation and provide the best resilience of the press button.

6 Claims, 6 Drawing Sheets

MICROSWITCH

FIELD OF THE INVENTION

The present invention generally relates to microswitches, more particularly to a microswitch that provides several operating directions for opening/closing an electric switch.

BACKGROUND OF THE INVENTION

In view of the low precision for manufacturing and assembling "small switches" as disclosed in the R.O.C. Patent Publication No. 517254 and "lever switches" as disclosed in the U.S. Publication No. 2002/0148714, the inventor of this invention had made improvements over the foregoing prior arts and filed a R.O.C. patent application entitled "Microswitch (II)". Such patent application granted and published with Publication No. 562228 discloses an easy-to-assemble and easy-to-manufacture microswitch without changing the dimensions of existing products or requiring a complicated manufacturing process or strict precision control. The easy-to-assemble and easy-to-manufacture microswitch comprises a connecting section disposed between first and second conductive sections of a resilient component used for opening/closing an electric switch, a fixing section coupled to the resilient component and disposed in an accommodating groove of a press button at the position corresponding to the connecting section, so that the first conductive section of the resilient component is kept constantly in contact with a first contact section of the first conductive terminal extended into a chamber, and the second conductive section is moved downward by a force produced by pressing on a pressing section of the press button at a position corresponding to the contact of the press button with a second contact section of the second conductive terminal being extended to the chamber.

Although the switch according to this patent has solved the precision problem, it still cannot meet the strict requirements of the microswitch such as the distance required for the signal connection and the quick restoration of the press button after being released mainly due to the parallel arrangement of the first and second conductive terminals disposed in the chamber of the main body. Therefore, the distance required for signal connections is limited by the provided space. In addition, the distance between the first and second conductive sections of the resilient component is short, as shown in the drawings of the patent specification. Thus the compression produced by the press button is limited, and the press button cannot quickly resume its original position after being released.

SUMMARY OF THE INVENTION

The primary objective of the present invention is to overcome and avoid the foregoing shortcomings. This invention provides a microswitch that is easy to assemble and manufacture. The microswitch of this invention constantly keeps the first conductive section of a resilient component for opening/closing an electrical switch in contact with the first conductive terminal in the main body of the microswitch, and houses a plate-shaped second conductive section with a contact surface inside the main body of the microswitch, so that the second conductive section of the resilient component is driven by a press button on the contact surface of the second conductive terminal to preset the signal from an initial connection state to a final connection state in order to increase the distance required for controlling the signal connection and allow the resilient component to have an effective deformation and provide the best resilience of the press button.

DETAILED DESCRIPTION OF THE PREFERRED EMBODIMENTS

Figure 1:
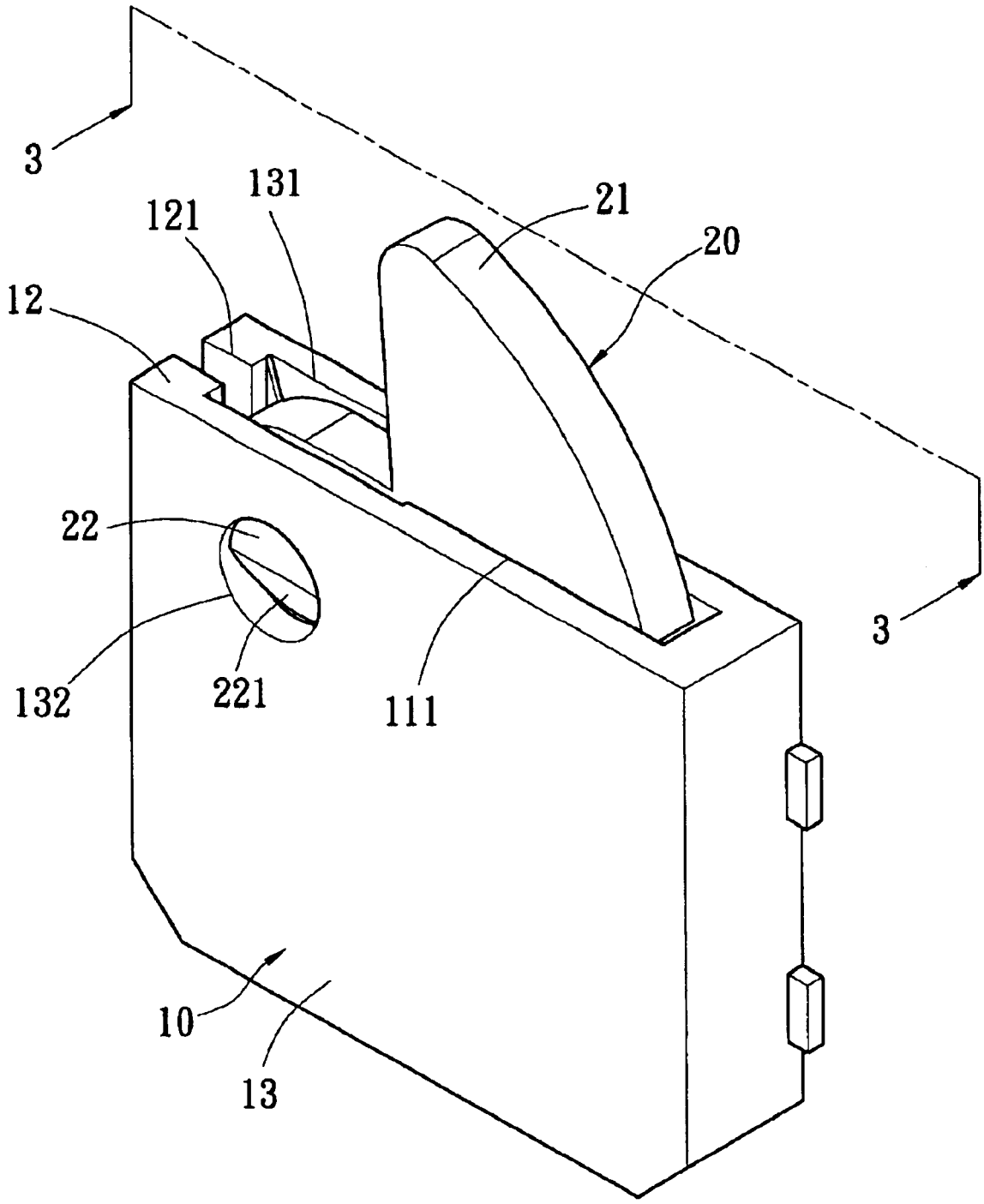
FIG. 1 is a perspective diagram of the present invention.
Figure 2:
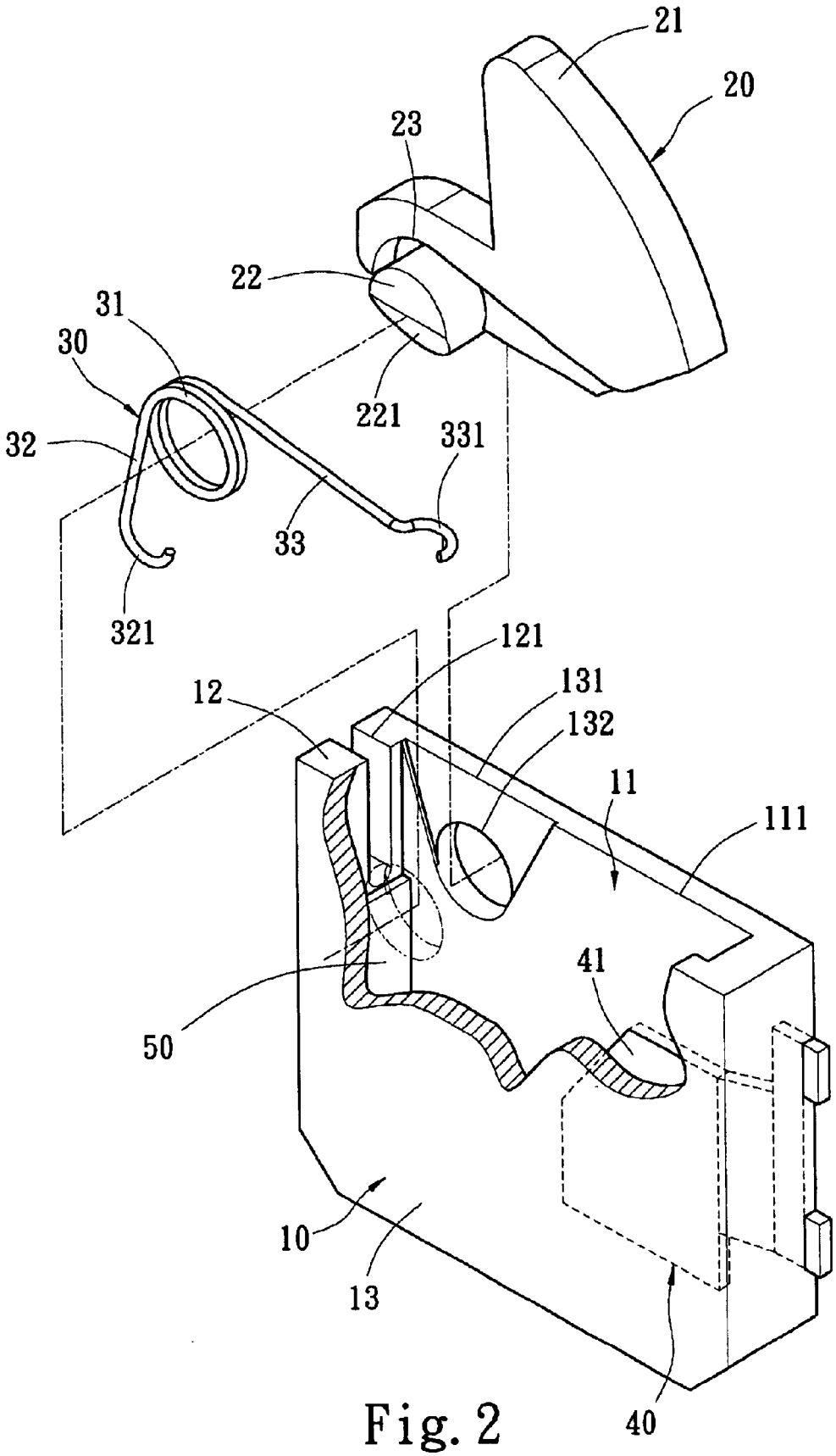
FIG. 2 is a view of the disassembled parts of the structure of the present invention.
Figure 4:
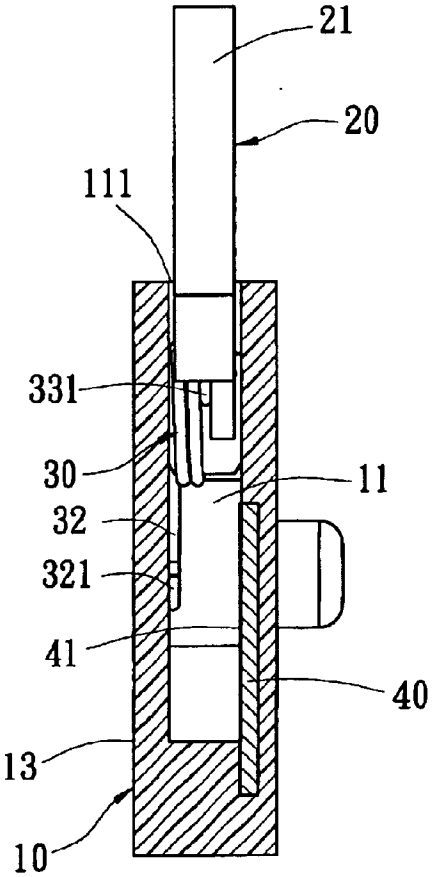
FIG. 4 is a cross-sectional view of the section 4—4 in FIG. 3.
Figure 3:
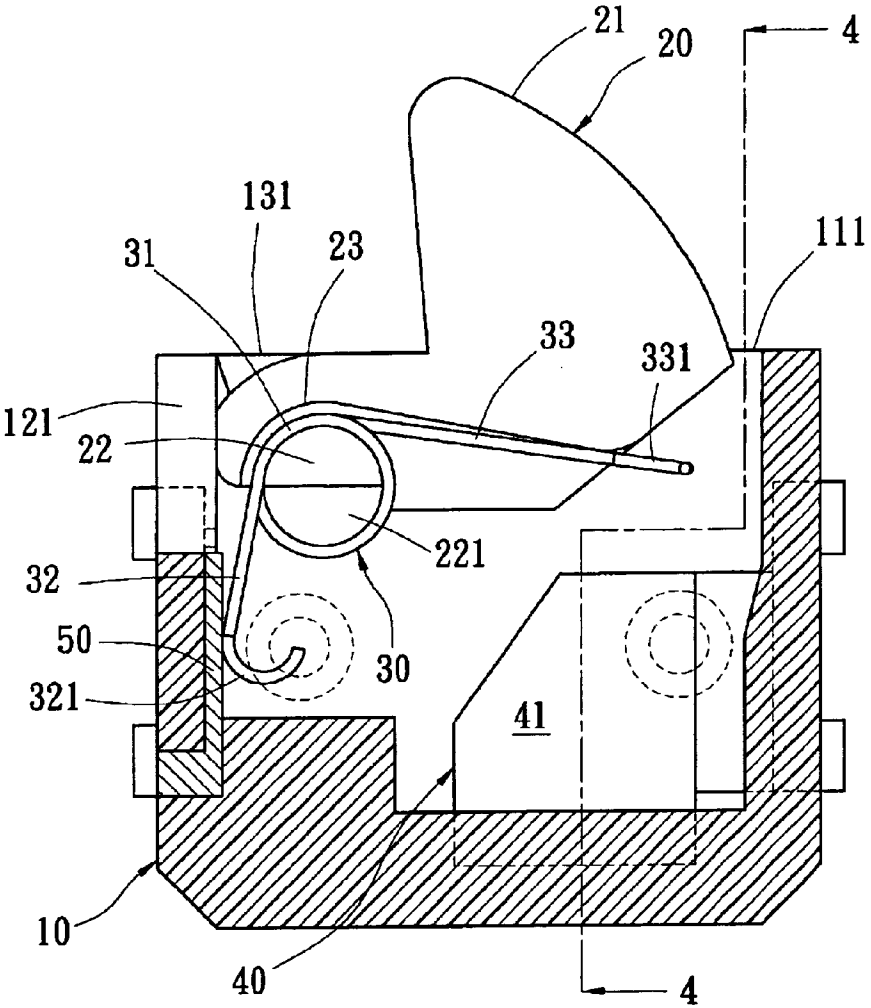
FIG. 3 is a cross-sectional view of the section 3—3 in FIG. 1.

To make it easier for our examiner to understand the objective of the present invention, its structure, innovative features, and performance, we use a preferred embodiment together with the attached drawings for a detailed description of the invention.

Please refer to FIGS. 1 to 4 for the present invention. The microswitch of the invention comprises: a main body 10 having a chamber 11 therein; a first conductive terminal 50 and a second conductive terminal 40 disposed on the chamber, and the first and second terminals 50, 40 being vertically disposed in the chamber 11; a press button 20 disposed in the chamber 11 for supporting and allowing free rotation on the main body 10; a force acting section 21 disposed at the bottom of the press button 20 for providing an elastic force to push the press button 20 up and protruded from the main body 10; and a resilient component 30 having a first conductive section 32 and a second conductive section 33 for contacting the first conductive terminal 50 and the second conductive terminal 40 respectively, wherein the first and second conductive sections 32, 33 of the resilient component 30 bent to define a first electric connection end 321 and a second electric connection end 331, and the first electric connection end 321 and a second electric connection end 331 being bent perpendicularly; a circular hole 132 disposed on both sides of the main body 10 corresponding to a fixing section 22 of the press button 20, and an accommodating groove 131 extended from the circular hole 132 to an open end 111 of the chamber 11, and the accommodating groove 132 being tapered from the open end 111 to the circular hole 132; an opening 121 disposed on a sidewall 12 of the main body 10 proximate the circular hole 132 and being extended to the open end 111 of the chamber 11; an aslant conductive connecting surface 221 being formed at the lower edge of the fixing section 22 of the press button 20.

Further, an assembling section 31 formed between the first and second electric conductive sections 32, 33 of the resilient component 30. An accommodating groove 23 disposed on the push button 20 at a position corresponding to the assembling section 31 comprising a fixing section 22 for connecting the resilient component 30. The first conductive section 32 and the first conductive terminal 50 of the resilient component 30 are kept constantly in contact with each other, and the second conductive section 32 is pushed down by a force provided by pressing the press button 20, and the contact surface 41 of the second conductive section 33 and the second terminal 40 should satisfy the conditions for the initial signal connection state to the final signal connection state preset by the microswitch.

Figure 6:
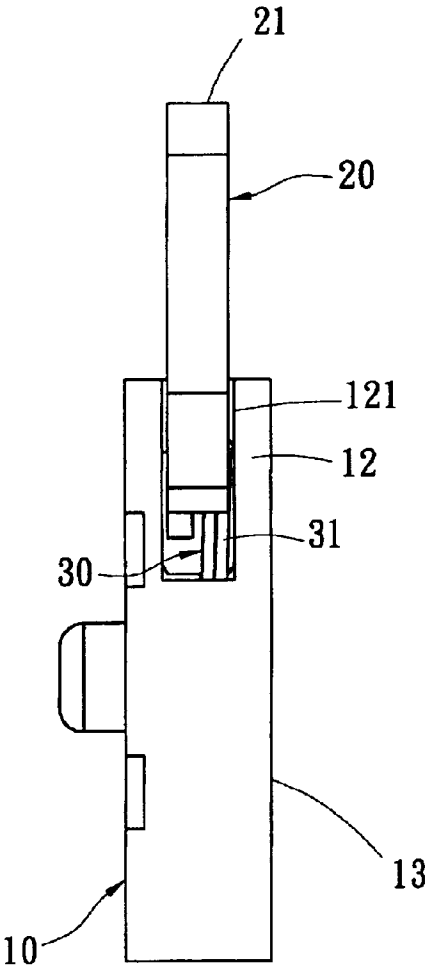
FIG. 6 is a side view of the assembly of the present invention.
Figure 5:
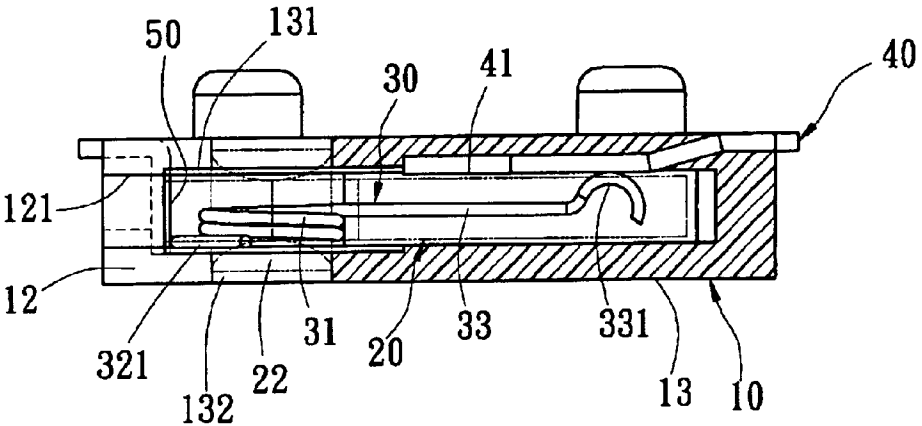
FIG. 5 is a top view of the assembly of the present invention.
Figure 7B:
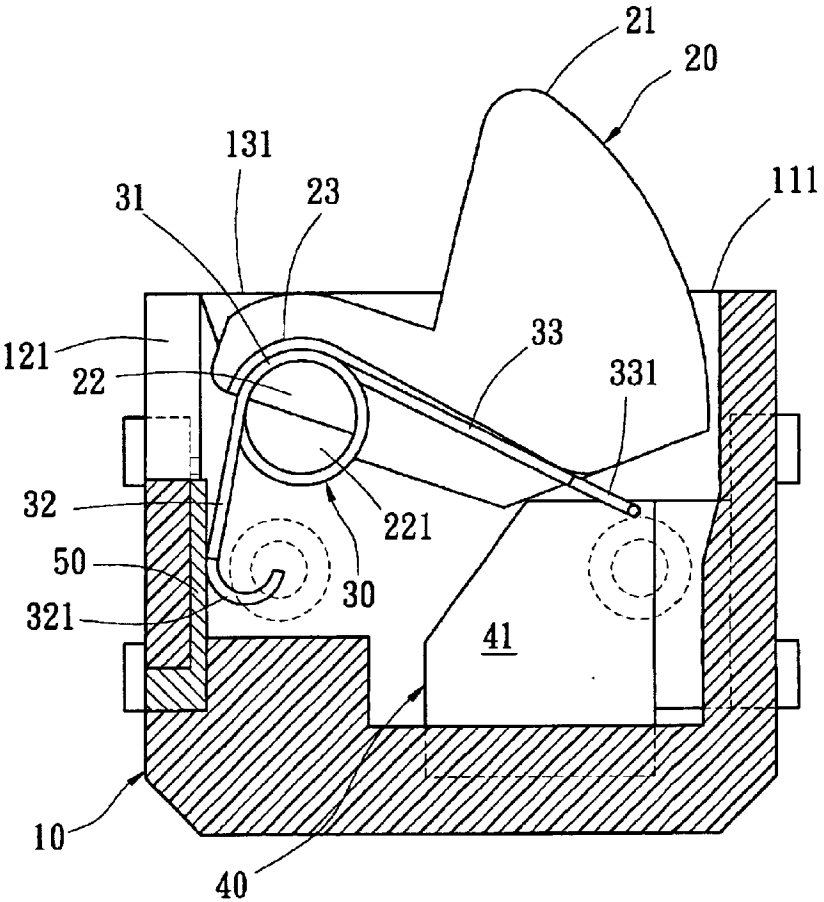
FIGS. 7A, 7B, and 7C are illustrative views of the movements made when a force is acted from the left side in the vertical plane.
Figure 7A:
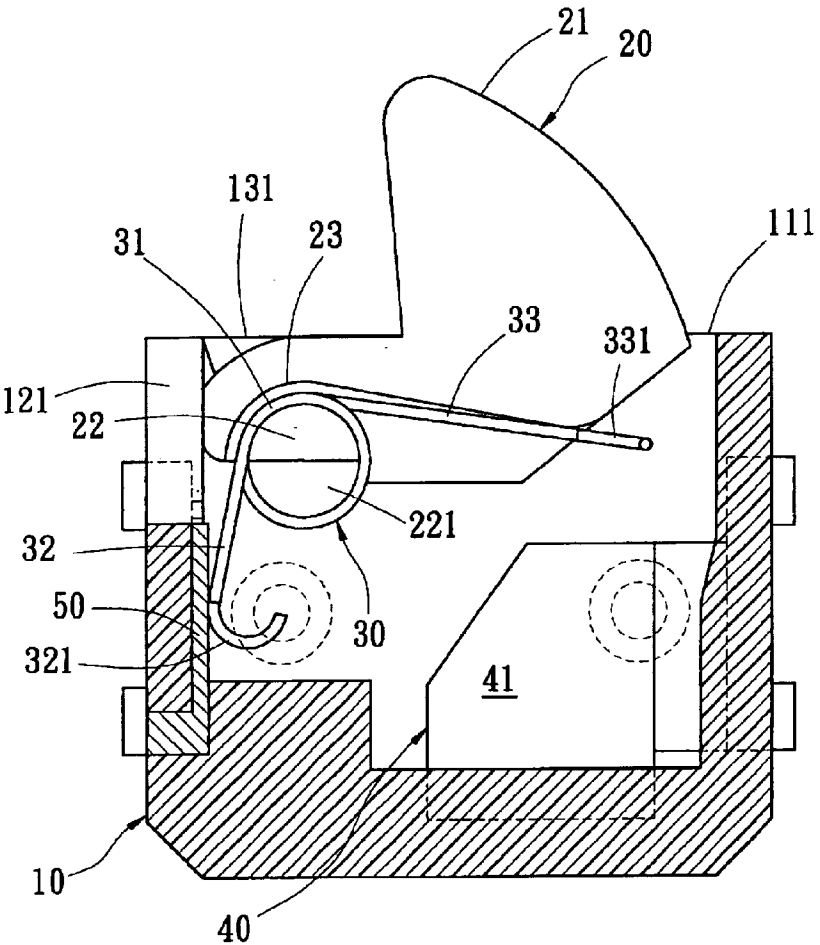
Figure 7C:
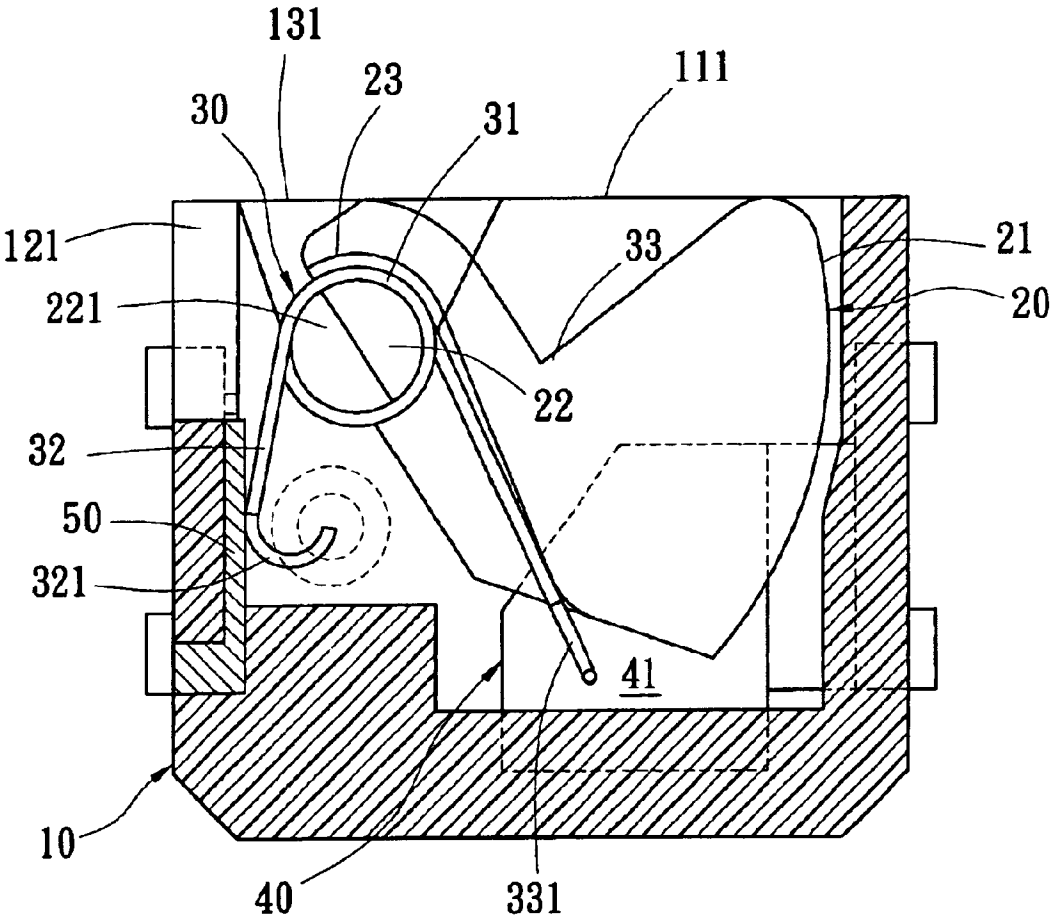

From FIGS. 5, 6, and 7A, it is obvious that the second conductive terminal 40 in a plate shape is disposed in a chamber having a contact surface 41, and the bent second electric connection end 331 of the second conductive section 33 of the resilient component 30 disposed on the top of the contact surface 41. When the press button 20 is pushed from the left direction or the vertical plane, the press button 20 will rotate and shift downward by making use of the fixing section 22 as the fulcrum, and drive the second conductive section 33 of the resilient component 30 to move down simultaneously. Since the first conductive section 32 of the resilient component 30 and the first conductive terminal 50 are always in contact with each other, therefore when the press button 20 moves to the highest point, the second electric connection end 331 of the second conductive section 33 is coupled to the contact surface 41 of the second conductive terminal 40 to define the initial signal connection state as shown in FIG. 7B; when the press button 20 moves to the lowest point, the contact surface 41 of the second conductive terminal 40 satisfies the requirements for depression distance of the press button 20, so that the second electric connection end 331 of the second conductive section 33 can keep the contact area 41 in an electric connection state when the press button 20 is depressed as shown in FIG. 7C. Therefore, when the press button 20 moves to the lowest point, it defines a final signal connection state, and the signal traveling distance from the initial signal connection state to the final signal connection state can meet the actual moving distance design of the press button 20. The microswitch of the present invention provides the best design for the signal traveling distance. Further, since the current of the microswitch is very small, therefore when the second electric connection end touches the contact surface 41 it does not produce any spark, and does not cause danger or accidents.

Further, FIGS. 7A to 7C obviously show that the distance between the first conductive section 32 of the resilient component 30 and the second conductive section 33 is larger than the traditional microswitch. Therefore, when the press button 20 moves to the lowest point, the stored resilience of the resilient component 30 is increased; and when the press button 20 is released, the press button 20 can resume its position quickly, and effectively release the signal connection state.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A microswitch comprising a main body having a chamber therein, and the main body having a first conductive terminal and a second conductive terminal disposed on the chamber, a press button disposed on the chamber for supporting and allowing free rotation on the main body, a force acting section disposed at the bottom of the press button for providing an elastic force to push the press button up and protruded from the main body; and a resilient component having a first conductive section and a second conductive section for contacting the first conductive terminal and the second conductive terminal respectively, characterized in that:

an assembling section, defined between said first and second conductive sections of said resilient component;

a fixing section, coupled to said resilient component and disposed in an accommodating groove of said press button at the position corresponding to said assembling section, and the first conductive section of said resilient component being kept constantly in contact with said first conductive terminal, and said second conductive section being pressed downwards by a force provided by said press button to contact the second conductive terminal, and said second conductive section and the contact surface of said second conductive terminal meeting the requirements for said initial signal connection state to said final signal connection state preset by said microswitch.

2. The microswitch of claim 1, wherein said main body on both sides comprises a circular hole and an accommodating groove being extended from said circular hole to an open end of a chamber, and an opening disposed on said main body at the position proximate to a sidewall of said circular hole and extending to an open end of said chamber, and an aslant conductive surface defined at the bottom edge of the fixing section of said press button.

3. The microswitch of claim 2, wherein said accommodating groove is tapered from said open end to said circular hole.

4. The microswitch of claim 1, wherein said first and second conductive sections of said resilient component comprises first and second conductive ends, bent perpendicular to each other.

5. The microswitch of claim 1, wherein said first and second conductive terminals are disposed in said chamber perpendicular to each other.

6. A microswitch, comprising a main body having a chamber therein, and the main body having a first conductive terminal and a second conductive terminal disposed on the chamber, a press button disposed on the chamber for supporting and allowing free rotation on the main body, a force acting section disposed at the bottom of the press button for providing an elastic force to push the press button up and protruded from the main body; and a resilient component having a first conductive section and a second conductive section for contacting the first conductive terminal and the second conductive terminal respectively, characterized in that:

said second conductive terminal being in the shape of a plate disposed in said chamber and having a contact surface, and the second conductive section of said resilient component being driven by said press button to move on the contact surface of said second conductive terminal to define said initial signal connection state to said final signal connection state preset by said microswitch.

* * * * *